US005575308A

United States Patent [19]

Marandi

[11] Patent Number: 5,575,308

[45] Date of Patent: Nov. 19, 1996

[54] TORQUE-RESISTING ANCHOR FOR IRRIGATION VALVE

[76] Inventor: Ali Marandi, 4482 Elm Tree La., Irvine, Calif. 92715

[21] Appl. No.: 517,135

[22] Filed: Aug. 21, 1995

[51] Int. Cl.[6] ..... F16L 5/00

[52] U.S. Cl. ..... 137/356; 52/165; 405/244

[58] Field of Search ..... 137/356; 52/155, 52/165; 405/244

[56] References Cited

U.S. PATENT DOCUMENTS

| | | | |
|---|---|---|---|
| 3,342,444 | 9/1967 | Nelson | 52/165 |
| 4,320,608 | 3/1982 | Deike | 52/165 |
| 4,649,678 | 3/1987 | Lamson | 52/165 X |
| 5,487,235 | 1/1996 | Gober | 52/155 X |

*Primary Examiner*—Kevin Lee
*Attorney, Agent, or Firm*—Roy A. Ekstrand

[57] ABSTRACT

An anchor body defines an open-end receptacle suitable for receiving the valve body of a quick coupling irrigation valve. The anchor body defines an end portion having a threaded aperture therein which receives a threaded bolt. The threaded bolt is adjusted to provide a captivating force upon the valve body and secure it within the open end receptacle. The anchor body further defines a pair of oppositely extending vertical vanes on each side of the open end receptacle together with a pair of horizontal vanes. The vertical vanes cooperate with the surrounding soil pack when the anchor is installed to resist torsional forces applied to the valve while the horizontal vanes cooperate with the surrounding soil to resist vertical forces upon the valve.

11 Claims, 2 Drawing Sheets

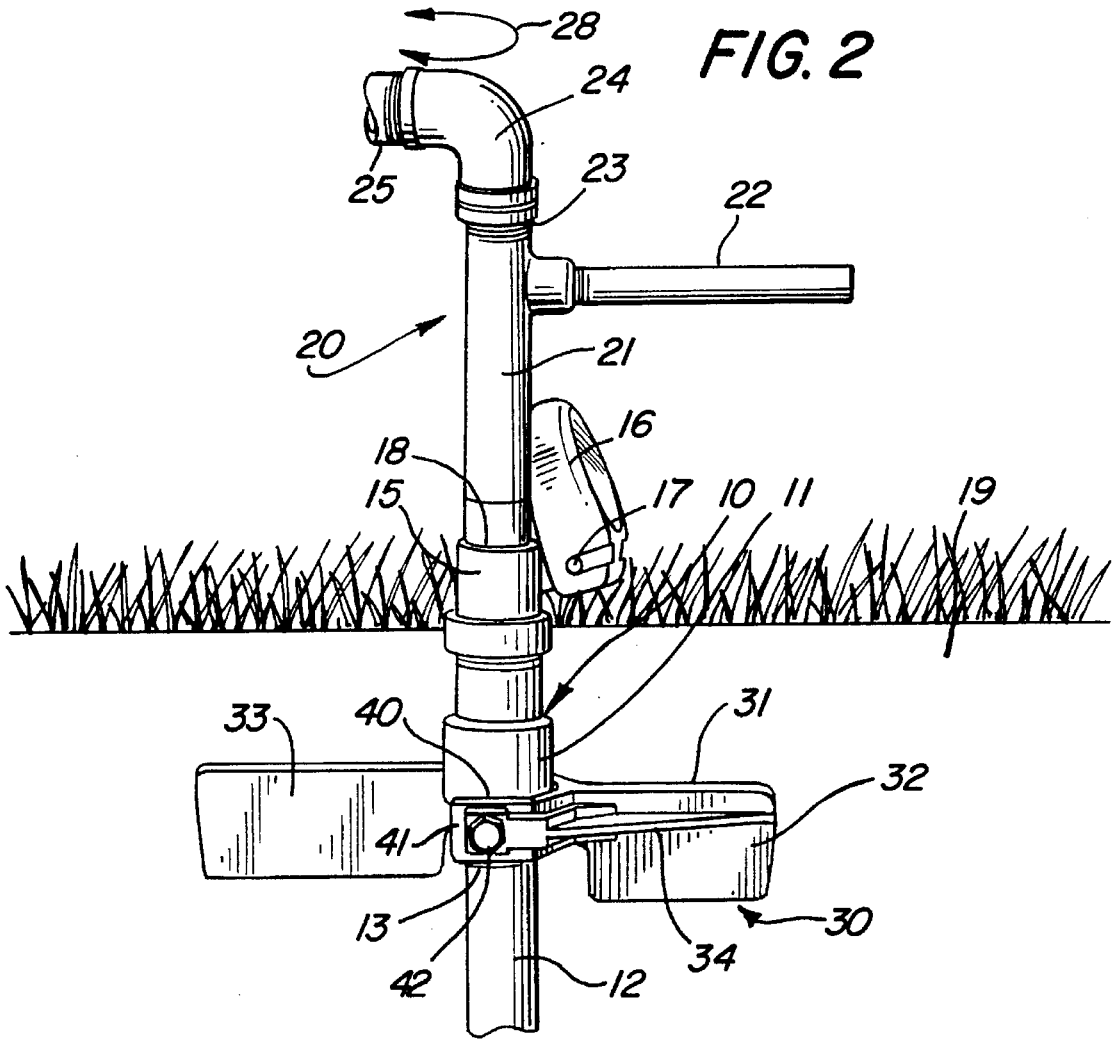
FIG. 2
FIG. 4
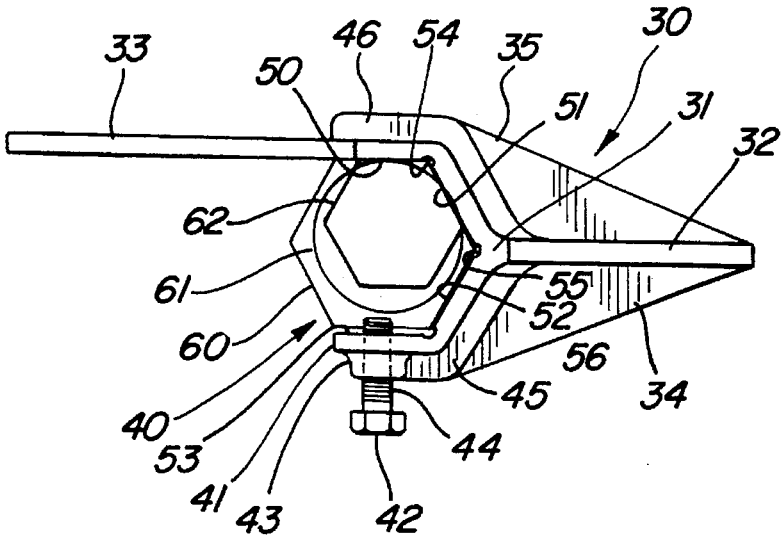

TORQUE-RESISTING ANCHOR FOR IRRIGATION VALVE

FIELD OF THE INVENTION

This invention relates generally to irrigation systems and particularly to the quick coupling valve apparatus used therein.

BACKGROUND OF THE INVENTION

In many irrigation systems, the need arises to facilitate supplemental watering of the irrigated areas as well as access to water under pressure for washing of pavement areas such as sidewalks or the like. To facilitate this need to provide supplemental watering and washing capability, irrigation systems frequently provide additional vertical supply pipes rising upwardly from the irrigation main line systems together with vertically extending valves known in the art as "quick coupling valves". Such valves are intended to provide access to water under pressure for coupling a hose fitting or the like to the water supply using a convenient key which functions as a valve actuater and as a coupling pipe to receive and secure the hose fitting. In most instances, the valve is positioned such that a key receptacle extends above the surrounding soil surface. A pivotally secured valve cover is secured to the key receptacle and provides protective closure of the key receptacle interior components and valve apparatus.

While the structures of such quick coupling valves and their installation is subject to some variation, all generally comprise the same basic operative components. FIG. 1 sets forth a perspective view of a typical prior art quick coupling valve and related installation and components. Thus, with reference to FIG. 1, a quick coupling valve 10 is shown positioned within a surrounding soil pack 19 in a typical installation. Valve 10 includes a valve body supporting a generally cylindrical key receptacle 15 extending upwardly from valve body 11 and defining a key passage 18 extending downwardly. Valve body 11 further includes a threaded attachment nut 14 which is threadably received upon a plurality of threads 13 formed on a vertically extending supply pipe 12. Supply pipe 12 is coupled to a convenient portion of the irrigation feed system having water under pressure (not shown). Thus, water under pressure is present within supply pipe 12 and restrained by the operative mechanism of valve 10. In further accordance with conventional fabrication techniques, a valve key 20 includes an elongated generally cylindrical hollow key body 21 having an end portion received within passage 18 and coupled to the operative mechanism of valve 10. Valve key 20 further includes a horizontally extending handle 22 and a plurality of threads 23 at the upper end thereof. A conventional threaded elbow fitting 24 is received upon threads 23 and further receives a hose fitting 25 in a conventional attachment. Key receptacle 15 further supports a pivotally attached valve cover 16 having a pivot pin 17 passing therethrough. In the absence of valve key 20, valve cover 16 pivots downwardly upon the upper end of key receptacle 15 providing a protective closure of receptacle 15.

While not seen in FIG. 1, in accordance with conventional fabrication techniques, the valve mechanism within valve 10 includes a spirally configured keyway. Correspondingly, the lower end of valve key 20 includes a hollow tube having a side lug cast on the side portion thereof which extends into the spirally configured keyway of the valve. Once the key is inserted into the valve body and rotated through a distance between ninety and one hundred eighty degrees, its lower end portion is forced against a spring loaded poppet valve in the valve body. Once the poppet is driven away from its seat, a flow of water then travels upwardly through the valve body, key receptacle and hollow key body 21 to pass through elbow 24 and hose fitting 25. The closure of valve 10 is carried forward in a basically reverse operation in which handle 22 is pivoted counterclockwise causing valve key 20 to move upwardly due to the cooperation of the key lug and spirally configured keyway in the valve body. The upward movement and removal of valve key 20 allows the spring loaded poppet to return to its closed position terminating water flow.

While such quick coupling valves are important to the full use and operation of certain irrigation systems, their operation in the above-described manner produces substantial torquing of the coupling between supply pipe 12 and valve body 11. This torquing in both directions indicated in FIG. 1 by arrows 28 tends to loosen and wear the threaded coupling between the valve body and supply pipe. Since the entire system pressure is applied against the valve in the closed position, the wearing of the threading coupling undermines the system integrity and may eventually lead to complete separation of the valve from the supply pipe. The packed soil about the quick coupling valve does little if anything to resist the torsional forces applied to the valve.

In response to the potential problems associated with failure of the valve to supply pipe attachment, practitioners in the art have typically provided torque resisting anchors secured to the valve body. FIG. 1 shows a typical torque resisting anchor of the prior art construction installed upon valve 10. Thus, an elongated member usually formed of an angle iron segment 26 defines a pair of apertures on each side of valve body 11 which in turn receive a U-shaped bolt 27. While not seen in FIG. 1, it will be understood that the end portions of U-bolt 27 extending through angle iron 26 are threaded and receive conventional threaded fasteners and locking nuts. The objective is to tighten U-bolt 27 against angle iron 26 captivating and securing valve body 11. Angle iron 26 is intended to be supported by soil pack 19 and resist torsional forces upon valve 10.

While the prior art attempts to provide torque resisting anchors for such quick coupling valve have, in some instances provided improvement, they have often proven themselves to be ineffective or marginally effective. For example, the rising and lowering of soil pack 19 and valve 10 due to normal expansion and contraction of irrigation system components and pressure within the system as well as the swelling and compacting of the soil pack often induce slippage between U-bolt 27 and valve body 11. This slippage eventually allows U-bolt 27 to slip away from valve body 11 rendering the valve anchor mechanism virtually ineffective. In addition, such U-shaped bolts as U-bolt 27 provide a relatively small gripping force against torque over a long term in that they have a tendency to wear if subjected to torque or stretch and loosen.

There arises therefore a need in the art for a more effective torque resisting anchor for irrigation valves.

SUMMARY OF THE INVENTION

Accordingly, it is a general object of the present invention to provide an improved torque resisting anchor for irrigation valves. It is a more particular object of the present invention to provide an improved torque resisting anchor for irrigation valves which reliably attaches to the valve body and which effectively resists torsional force. It is a still more particular object of the present invention to provide an improved torque resisting anchor for irrigation valves which accommodates a variety of valve body shapes and sizes while maintaining a reliable secure attachment. It is a still more particular object of the present invention to provide an improved torque resisting anchor for irrigation valves which utilizes an open-end type attachment receptacle which facilitates installation subsequent to valve installation within the irrigation system. It is a still further object of the present invention to provide an improved torque resisting anchor for irrigation valves which in addition to resistance to torsional forces provides improved resistance to vertical movement.

In accordance with the present invention, there is provided for use in combination with a valve having a valve body to which a valve key is applied and pivotally moved to open and close the valve, a valve anchor for resisting torsional and vertical forces upon the valve body, said valve anchor comprising: an anchor body defining an open-end receptacle for receiving a portion of the anchor body; a first vertical vane integral with the anchor body and extending in a first generally horizontal direction from the open-end receptacle; a second vertical vane integral with the anchor body and extending in a second generally horizontal direction, substantially opposite to the first direction, from the open-end receptacle; and attachment means supported by the anchor body for securing the valve body within the open-end receptacle.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

FIG. 2 sets forth a perspective view of a quick coupling valve and valve key having the present invention torque resisting anchor secured thereto;

FIG. 4 sets forth a top plan view of the present invention torque resisting anchor for irrigation valve showing various sizes and shapes of valve bodies secured therein.

DESCRIPTION OF THE PREFERRED EMBODIMENT

Figure 1:
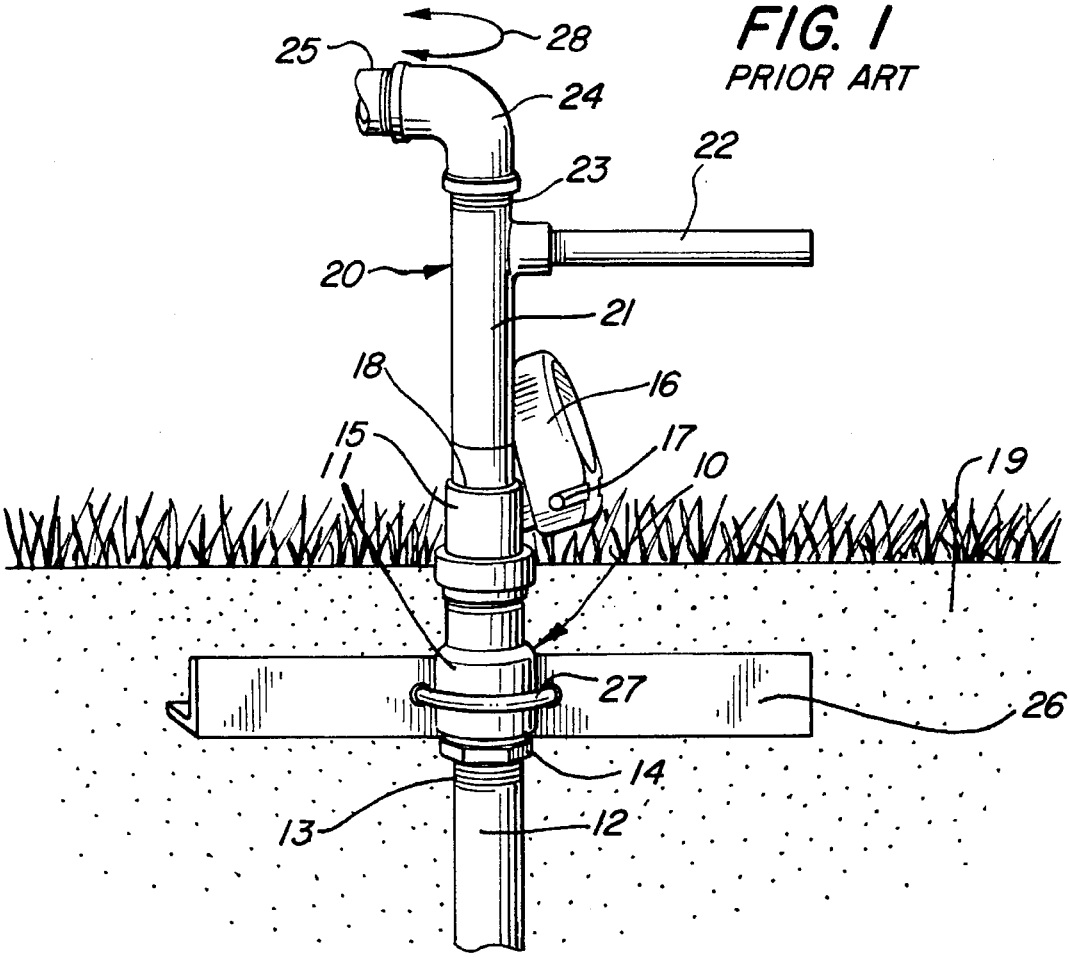
FIG. 1 PRIOR ART
FIG. 1 sets forth a perspective view of a quick coupling valve and valve key together with a prior art valve anchor secured thereto.

FIG. 2 sets forth a perspective view of a conventional quick coupling valve generally referenced by numeral 10 in a typical installation upon a supply pipe 12. FIG. 2 further shows a conventional valve key generally referenced by numeral 20 received within valve 10 in accordance with conventional operation techniques. FIG. 2 also shows a torque-resisting anchor constructed in accordance with the present invention and generally referenced by numeral 30 secured to valve 10 in accordance with the invention. Thus, as is set forth above, valve 10 is constructed in accordance with conventional fabrication techniques and includes a valve body 11 supporting a key receptacle 15 defining a key passage 18 therein. Valve receptacle 15 further supports a valve cover 16 in a pivotable attachment using a pivot 17. In further accordance with conventional fabrication techniques, valve body 11 is secured to a supply pipe 12 using threads 13 formed thereon. Valve key 20 defines a hollow key body 21 having a lower end received within key passage 18 and an upper end defining threads 23. Valve key 20 further includes a horizontally extending handle 22. A conventional elbow fitting 24 is threadably received upon threads 23 and is further coupled to a conventional hose fitting 25.

The operation of valve 10 and valve key 20 is described above and remains the same in the embodiment of the present invention shown in FIG. 2. Thus, handle 22 of valve key 20 is turned to provide rotational motion of hollow key body 21 which in one direction opens valve 10 and in the remaining direction allows valve 10 to close and allows removal of key 20.

In accordance with the present invention, anchor 30 includes an anchor body 31 defining a pair of vertical vanes 32 and 33 extending outwardly therefrom. Vanes 32 and 33 are sufficient in size and area to engage soil pack 19 to prevent rotational motion of anchor 30. Anchor body 31 further defines a pair of horizontal vanes 34 and 35 (the latter seen in FIG. 3). Horizontal vanes 34 and 35 perform dual functions of strengthening vertical vane 32 and engaging the surrounding soil of soil pack 19 to resist vertical motion of anchor 30 and valve 10. In further accordance with the present invention, anchor body 31 defines an open-end receptacle 40 formed between vertical vane 33 and side portion 41 of body 31. As is better seen in FIG. 3, open-end receptacle 40 is formed of a plurality of vertical oriented facets 50, 51, 52 and 53 forming an open-end socket or receptacle suitable for receiving and securing a hexagonal shape nut such as nut 14 formed on valve body 11 (seen in FIG. 1). As is also better seen in FIG. 3, end 41 defines a threaded aperture 44 which receives a threaded bolt 42. Returning to FIG. 2, it will be apparent that anchor 30 is secured to valve 11 by moving anchor 30 such that valve body 11 is received within open-end receptacle 40. As is better seen in FIG. 4, the faceted structure of open-end receptacle 40 threadably receives and secures both cylindrical and hexagonally configured valve bodies. Thus, with anchor 30 received upon valve body 11 of valve 10 in the manner shown in FIG. 2, bolt 42 is tightened within the threaded aperture of side 41 to drive the end portion of bolt 42 against the underlying portion of valve body 11. The tightening of bolt 42 captivates valve body 11 within open-end receptacle 40 and reliably secures anchor 30. In the preferred form of the invention, bolt 42 is fabricated of a substantially harder material than typically utilized in forming valve body 11. The result is the creation of an indentation within valve body 11 at the point of pressure contact of bolt 42 as the bolt is tightened. This pressure contact and indentation serves to better secure anchor 30 to valve body 11.

In the anticipated installation of the present invention anchor, it is expected that once anchor 30 is secured to valve 10 in the manner described, soil pack 19 is formed about valve 10 and anchor 30 to provide a surrounding soil area which cooperates with vertical vanes 32 and 33 to resist rotational motion of valve 10 due to torsional forces created by manipulation of valve key 20. It is further anticipated that the surrounding support of soil pack 19 encloses horizontal vanes 34 and 35 (the latter seen in FIG. 3) to resist motion of anchor 30 and valve 10 with respect to soil pack 19. It should be noted that the use of open-end receptacle 40 facilitates the attachment of anchor 30 to valve 10 following the complete assembly of valve 10 to supply pipe 12 and receptacle 15. That is to say, open-end receptacle 40 allows anchor 30 to be assembled to valve 10 in a simple slide on motion afterwhich bolt 42 is tightened.

In the event the user desires to further enhance the strength of coupling between anchor 30 and valve body 11, a drilled indentation may be formed within valve body 11 to receive the interior end of bolt 42. However, it has been found in most instances that the tendency of bolt 42 to form its own indented portion of valve body 11 as it is tightened makes this additional step unnecessary in most installations. While it will be apparent to those skilled in the art that anchor 30 may be fabricated using virtually any material, it has been found advantageous in view of strength requirements and cost considerations to fabricate anchor 30 using a cast iron material for anchor body 31 and a steel bolt for bolt 42. As is better seen in FIG. 3, the strength of anchor body 31 in the portion thereof forming open-end receptacle 40 is enhanced by the formation of a boss 43 surrounding aperture 44 and a rib 45 extending along facets 52 and 53. While not seen in FIG. 3, it should be understood that a similar rib is formed along the outside of anchor body 31 to strengthen the body portions supporting facets 50 and 51. Returning to FIG. 2, it should also be noted that horizontal vanes 34 and 35 in addition to providing resistance to vertical movement also serve to strengthen and further support vertical vane 32.

Figure 3:
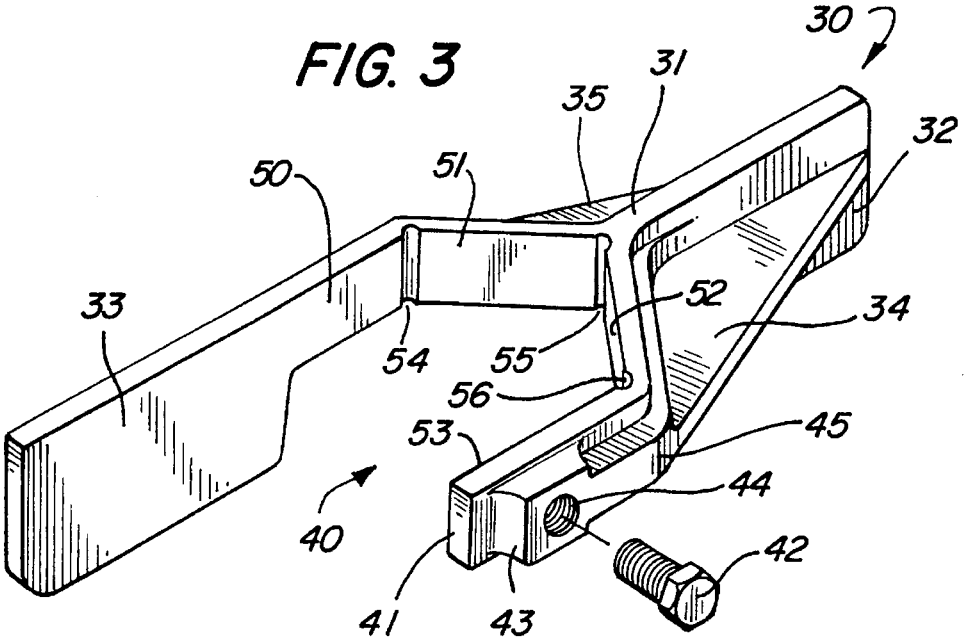
FIG. 3 sets forth a perspective assembly view of a torque resisting anchor for irrigation valve constructed in accordance with the present invention.

FIG. 3 sets forth a perspective assembly view of torque-resisting anchor 30. As described above, anchor 30 includes an anchor body 31 having an open end receptacle 40 formed by a plurality of generally planar facets 50, 51, 52 and 53. Anchor body 31 further defines a vertical vane 31 extending from the junction of facets 51 and 52. Anchor body 31 also includes an end portion 41 having a boss 43 and rib 45 formed thereon. Boss 43 further defines a threaded aperture 44 which extends through boss 33, end 41 and facet 53. A conventional threaded bolt 42 is received within threaded aperture 44. Rib 45 formed upon end 41 extends from boss 43 and conforms generally to anchor body 31 to provide strengthening body 31 along one side of open receptacle 40. While not seen in FIG. 3 due to the perspective view, it will be understood by those skilled in the art that an additional rib similar to rib 45 extends along the outer surface of anchor body 31 opposite to facets 50 and 51 to provide further strengthening of open receptacle 40. As is better seen in FIG. 4, anchor body 31 further includes a pair of horizontal vanes 34 and 35 extending between ribs 45 and 46 respectively and vertical vane 32. In addition to providing resistance to vertical motion of anchor 30 when installed in a supporting soil, horizontal vanes 34 and 35 provide additional strengthening of anchor body 31 to maintain the rigidity of anchor body 31 surrounding open end receptacle 40. Thus, as bolt 42 is threaded inwardly against a valve body received within open end receptacle 40, the spreading force produced against facets 50 and 53 is effectively resisted by the combination of ribs 45 and 46 and horizontal vanes 34 and 35. To assure that open end receptacle 40 properly fits hexagonally shaped portions of valve bodies, the intersections of the facets forming open end receptacle 40 are provided with relief cuts 54, 55 and 56.

FIG. 4 sets forth a top plan view of anchor 30 having a plurality of differently shaped and sized valve bodies shown within open end receptacle 40. More specifically, anchor 30 includes an anchor body 31 having vertical vanes 32 and 33 together with horizontal vanes 34 and 35 formed therein. Anchor body 31 defines a faceted open end receptacle 40 having facets 50, 51, 52 and 53. The intersections of the facets within open end receptacle 40 is undercut by corresponding reliefs 54, 55 and 56 to facilitate the fit of anchor 30 upon a hexagonal valve body. For additional strength, a pair of ribs 45 and 46 are formed upon anchor body 31 overlying open end receptacle 40. Further, body 31 defines an end 41 supporting a boss 43 having a threaded aperture 44 formed therein. A threaded bolt 42 is received within aperture 44.

In accordance with an important aspect of the present invention, the hexagonal open end configuration of receptacle 40 and the use of threadably adjustable bolt 42 within aperture 44 for securing the valve body within receptacle 40 facilitates the accommodation of valve bodies having different shapes and sizes. For purposes of illustration, anchor 30 is shown in FIG. 4 receiving a large hexagonal shape valve body 60, a smaller diameter cylindrical body 61 and a small hexagonal valve body 62. As can be seen, each different size and shape is readily received within receptacle 40 and, through the inward movement of bolt 42 within aperture 44, each is forced against facets 50 and 51 for secure attachment. Thus, the different shapes and sizes of valve bodies within open end receptacle 40 is accommodated due to the adjustable position of bolt 42 within threaded aperture 44. The capability of the present invention valve anchor to secure differently shaped valve bodies of different sizes greatly enhances the flexibility and value of the present invention valve anchor. In each case, the proper tightening of bolt 42 assures that a solid torque-resisting coupling is provided between anchor 30 and the captivated valve body. It will be apparent to those skilled in the art that while three different sized valve bodies illustrative of the three standard shape and size valve bodies in the marketplace is shown in FIG. 4, a variety of other shapes and sizes may readily be accommodated within anchor 30 should the need arise.

What has been shown is a new and improved torque-resisting anchor for irrigation valves which includes an open-end receptacle providing easy installation together with a simple threaded bolt attachment. The torque-resisting anchor includes vertically oriented vanes to resist torsional forces or rotational motion of the valve anchor together with horizontal oriented vanes to resist vertical motion of the valve anchor. The combined structure of horizontal and vertical vanes cooperates to strengthen the overall rigidity of the anchor body.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. For use in combination with a valve having a valve body to which a valve key is applied and pivotally moved to open and close the valve, a valve anchor for resisting torsional and vertical forces upon the valve body, said valve anchor comprising:

an anchor body defining an open-end receptacle for receiving a portion of said valve body;

a first vertical vane integral with said anchor body and extending in a first generally horizontal direction from said open-end receptacle;

a second vertical vane integral with said anchor body and extending in a second generally horizontal direction, substantially opposite to said first direction, from said open-end receptacle; and attachment means supported by said anchor body for securing said valve body within said open-end receptacle.

2. A valve anchor as set forth in claim 1 wherein said open-end receptacle defines a plurality of vertically oriented facets.

3. A valve anchor as set forth in claim 2 wherein said vertically oriented facets are arranged to conform to four sides of a hexagonally shaped portion of said valve body.

4. A valve anchor as set forth in claim 3 wherein said anchor body defines wall portions forming said vertically oriented facets.

5. A valve anchor as set forth in claim 4 wherein said anchor body defines raised ribs upon said wall portions.

6. A valve anchor as set forth in claim 5 wherein said attachment means includes a threaded aperture extending into said open-receptacle and a threaded bolt received within said threaded aperture, said bolt defining an inner end contacting said valve body to secure said valve anchor.

7. A valve anchor as set forth in claim 6 further including a pair of horizontal vanes extending outwardly from said first vertical vane and said wall portion in generally opposite directions.

8. A valve anchor as set forth in claim 1 further including a pair of horizontal vanes integrally formed with said anchor body and said first vertical vane.

9. For use in combination with a valve having a valve body to which a valve key is applied and pivotally moved to open and close the valve, a valve anchor for resisting torsional and vertical forces upon the valve body, said valve anchor comprising:

an anchor body defining a multifaceted open-end receptacle for receiving and fitting a hexagonally shaped valve body, said open-end receptacle formed by wall portions of said anchor body;

a pair of generally planar vertical vanes, formed integrally with said anchor body and extending in opposite directions; and attachment means for securing said anchor body to said valve body.

10. A valve anchor as set forth in claim 9 further including a pair of generally planar horizontal vanes integrally formed with one of said vertical vanes and said wall portions and extending in generally opposite directions.

11. A valve anchor as set forth in claim 10 wherein said attachment means includes a threaded aperture extending into said open-receptacle and a threaded bolt received within said threaded aperture, said bolt defining an inner end contacting said valve body to secure said valve anchor.

* * * * *